US008084953B2

(12) United States Patent
Xie et al.

(10) Patent No.: US 8,084,953 B2
(45) Date of Patent: Dec. 27, 2011

(54) CHANGING POWER INPUT TO A GAS DISCHARGE LAMP

(75) Inventors: Xuefei Xie, ShangHai (CN); Gang Yao, Shang Hai (CN); Chenghua Zhu, ShangHai (CN); Bo Zhang, ShangHai (CN)

(73) Assignee: General Electric Company, Schenectady, NY (US)

( * ) Notice: Subject to any disclaimer, the term of this patent is extended or adjusted under 35 U.S.C. 154(b) by 467 days.

(21) Appl. No.: 12/392,216

(22) Filed: Feb. 25, 2009

(65) Prior Publication Data

US 2010/0213864 A1 Aug. 26, 2010

(51) Int. Cl.
*H05B 37/02* (2006.01)

(52) U.S. Cl. ..... 315/219; 315/224; 315/225; 315/226; 315/240; 315/276

(58) Field of Classification Search ..... 315/209 R, 315/219, 221, 224, 225, 226, 227 R, 239, 315/240, 244, 276, 283, 291, 307, DIG. 5, 315/DIG. 7

See application file for complete search history.

(56) References Cited

U.S. PATENT DOCUMENTS

| | | | | |
|---|---|---|---|---|
| 4,100,476 | A * | 7/1978 | Ghiringhelli | 315/297 |
| 4,463,286 | A * | 7/1984 | Justice | 315/219 |
| 5,438,243 | A * | 8/1995 | Kong | 315/219 |
| 7,382,099 | B2 * | 6/2008 | Chen et al. | 315/291 |

* cited by examiner

*Primary Examiner* — Thuy Vinh Tran
(74) *Attorney, Agent, or Firm* — Fay Sharpe LLP

(57) ABSTRACT

The present disclosure thus provides a technique for providing multi-level operation of ballast circuitry for discharge lamps. In one version, an auxiliary capacitance is switched in and out of circuit by a user controlled switch for lower the frequency of the voltage from the inverter to the transformer resulting in lower power output to the lamps. In another version, the auxiliary capacitance may be switched in and out of circuit by a user operated switch wherein the capacitance is connected to the secondary or output winding of the transformer for selectively reducing power to the lamps for reduced illumination. In other versions, auxiliary inductances are selectively switched in and out of circuit to alter the frequency of the primary voltage to the transformer. In another version, an auxiliary winding is selectively switched in and out of the secondary of the transformer for providing normal and reduced level power to the lamps. In another version, a variable direct current power supply is provided to the coupled inductors of the ballast circuitry for user control of the power supply to the ballast circuitry.

7 Claims, 9 Drawing Sheets

CHANGING POWER INPUT TO A GAS DISCHARGE LAMP

BACKGROUND OF THE DISCLOSURE

The present disclosure relates to circuitry for supplying power to gas discharge lamps such as fluorescent lamps which generally require the generation of a relatively high voltage AC current for effecting operation of the lamp. Typically, the power circuitry for the gas discharge lamp includes a way of stepping up the power line or input voltage to the required level for effecting discharge of the lamp and the circuitry often includes a transformer and a ballast or driver circuit with a pulse generator or igniter "ON" circuit which usually includes a transformer. The circuitry required to effect operation of gas discharge lamps is thus somewhat complex and relatively costly and further provides only a single power level of operation for the lamp, generally at its rated current capacity. In order to improve the usage of gas discharge lamps and further reduce the power required for their operation, it has been desired to provide a low cost, simple and effective way of operating a gas discharge lamp at less than full current capacity where reduced illumination is needed during certain periods of operation to reduce the power consumption during such periods.

Referring to FIG. 7, a prior art circuit arrangement for powering gas discharge lamps such as fluorescent lamps is shown schematically in which a relatively low voltage direct current power supply is applied to the parallel coupled inductors L1, L2 which are connected to switching transistors Q1 and Q2. The base drive signals of Q1 and Q2 are typically generated from the primary windings of a transformer T1 and in conjunction with the diodes D1, D2 form a half bridge circuit. The alternative switching of Q1 and Q2 provides an AC current on the primary of T1 and generates a constant stepped up voltage on the secondary of T1, the frequency of which is determined by the resonant frequency of the circuit based upon L1, L2, C3, C4, output capacitor and the inductance of the transformer T1.

The circuitry of FIG. 7 is typically employed for what is commonly referred to as an instant-start ballast for a fluorescent lamp. The aforesaid ballast circuitry of the prior art for gas discharge lamps has thus provided a dedicated level of power input to the lamp through a given power line condition; whereas, it has been desired to provide a simple, low-cost way of enabling users of such gas discharge lamps to reduce the power input thereto and yet provide adequate power to effect illumination of the lamp albeit at a lower level.

SUMMARY OF THE DISCLOSURE

The present disclosure describes a circuit technique for modifying an existing ballast circuit for powering a gas discharge lamp such as a fluorescent lamp wherein in one version a capacitance is switched in circuit with the ballast to lower the resonant frequency thereof and thus reduce the power to the transformer primary. In another version, a capacitance is selectively switched in circuit with the transformer secondary to reduce the frequency of the output current and thus the power to the lamp. In another version, a variable voltage is supplied to the coupled inductors to change the power supply to the inverter. In another version, an auxiliary inductance is switched in circuit with the transformer primary to lower the frequency of the current to the transformer.

DETAILED DESCRIPTION OF THE PREFERRED EMBODIMENTS

Figure 1A:
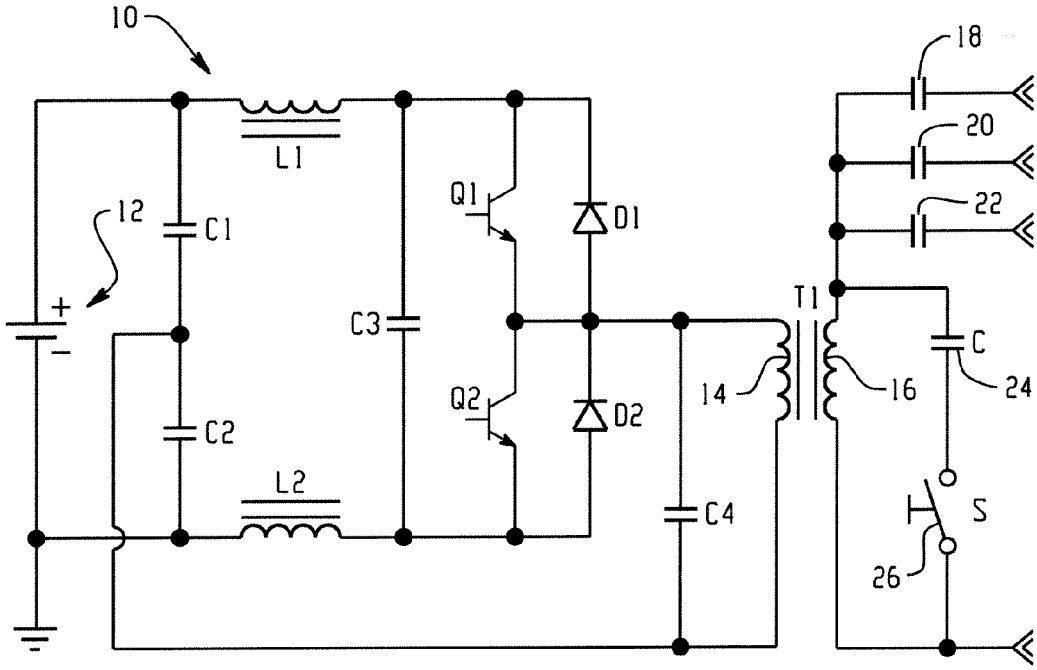
FIG. 1*a* is a schematic of a power circuit for a gas discharge lamp employing a switch for connecting an auxiliary capacitance in parallel with the output transformer secondary winding.

Referring to FIG. 1*a*, a power or ballast circuit in accordance with the present disclosure is indicated generally at 10 and includes a DC power supply 12, which may be rectified from an alternating current power line, which is supplied to an inverter indicated generally at 11 and comprising the coupled inductors L1, L2 and capacitors C1, C2, C3, the output of which is applied to the switching transistors Q1, Q2 in parallel with diodes D1, D2 to provide alternating current pulses in the form of an AC voltage applied to the primary winding 14 of a transformer T1. The secondary winding 16 of transformer T1 provides a stepped up voltage which is applied through capacitors 18, 20, 22 to individual gas discharge lamps (not shown).

An auxiliary capacitance denoted by the reference character C and reference numeral 24 is connected in parallel with the secondary transformer winding 16 and in series with a switch 26 which may be user operated. Upon closure of the switch, the addition of the capacitor 24 in the transformer secondary circuit is operative to reduce the frequency thereof and thus the power to the lamps; and, upon opening of the switch and removal of the capacitor 24 from the circuit, the normal, higher level frequency power from the transformer is applied to the lamps to provide normal or the higher level illumination thereof. The nominal values of the referenced circuit components are set forth herein in Table I for the basic circuit employed in the present disclosure.

TABLE I

| DESCRIPTION | QTY | REFERENCE |
|---|---|---|
| CAPACITOR, 22 uF, 250 V, 20% | 2 | C1, C2 |
| CAPACITOR, 0.68 nF, 700 V 5% | 1 | C3 |
| CAPACITOR, 1 nF, 700 V 5% | 1 | C4 |
| EE3528, 0.64 mH | 1 | T1 |
| EE20, 2 mH | 1 | L1 |
| EE20, 2 mH | 1 | L2 |
| BJT 1102E | 2 | Q1, Q2 |
| UF4007 | 2 | D1, D2 |
| 0.5 mH | 1 | N |

In the operation of the circuit in FIG. 1*a*, the ballast can operate either in a low ballast factor (0.71/0.77/0.78) or in a normal or high level mode with a ballast factor of 0.78/0.88 with the lower ballast factor being effected by switching the capacitor 24 in circuit.

Figure 1B:
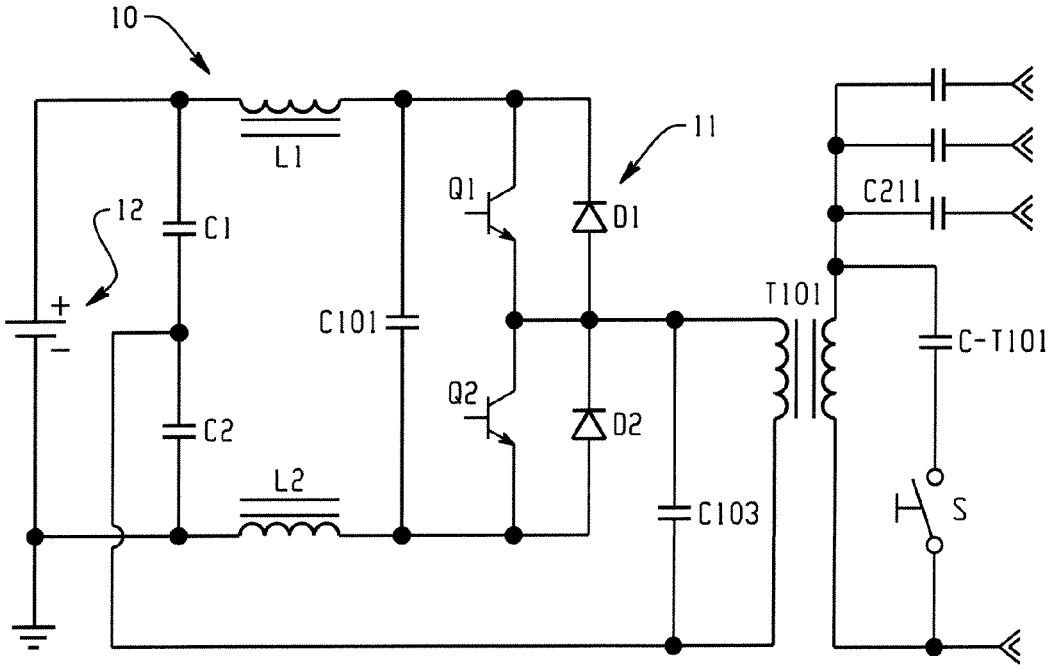
FIG. 1*b* is a schematic similar to FIG. 1*a* with specific values of capacitances and inductances given in Table II.

Referring to FIG. 1*b*, the circuit arrangement of FIG. 1*a* is shown with the capacitor for the transformer primary winding denoted as C103, the transformer denoted T101, the capacitors for the lamps in the transformer secondary circuit denoted C211 and the auxiliary capacitance denoted C-T101 for which experimental values were used as denoted in Table II.

TABLE II

| | | EFF | FOP | iLamp1 | iLamp2 | iLamp3 | iLamp4 | C211 | C101 | C103 | T101 |
|---|---|---|---|---|---|---|---|---|---|---|---|
| GE432-347V-IS 40.77~50.3 kHz | | | | | | | | | | | |
| N | 4N | 92.215 | 45.9 | 179.8 | 177.8 | 179.2 | 179 | 1 nF | 0.68 nF | 1.0 nF | 620 μH |
| | n-1 | | 50.3 | | | | | 1 nF | 0.68 nF | 1 nF | |
| L | 4L | 90.169 | 40.77 | 160.5 | 158.6 | 160 | 159.6 | 1 nF | 0.68 nF | 1.0//5.6 nF | |
| | n-1 | | 43.807 | | | | | 1 nF | 0.68 nF | 1.0//5.6 nF | |
| GE332-347V-IS 40.625~51 kHz | | | | | | | | | | | |
| N | 3N | 91.673 | 45.317 | 175.1 | 174.9 | 174.6 | | 1 nF | 0.68 nF | 0.82 nF | 810 μH |
| | n-1 | | 51 | | | | | 1 nF | 0.68 nF | 0.82 nF | |
| L | 3L | 90.014 | 40.625 | 156.9 | 156.6 | 156.2 | | 1 nF | 0.68 nF | 1.0//3.9 nF | |
| | n-1 | | 44.56 | | | | | 1 nF | 0.68 nF | 1.0//3.9 nF | |
| GE232-347V-IS 44.358~50.76 kHz, 60.87 kHz | | | | | | | | | | | |
| N | 2N | 90.966 | 50.583 | 182.7 | 182 | | | 1 nF | 0.68 nF | 1 nF | 1100 μH |
| | n-1 | | 60.87 | | | | | 1 nF | 0.68 nF | 1 nF | |
| L | 2L | 89.93 | 44.358 | 160.8 | 160.2 | | | 1 nF | 0.68 nF | 1.0//3.3 nF | |
| | n-1 | | 50.767 | | | | | 1 nF | 0.68 nF | 1.0//3.3 nF | |

Figure 2A:
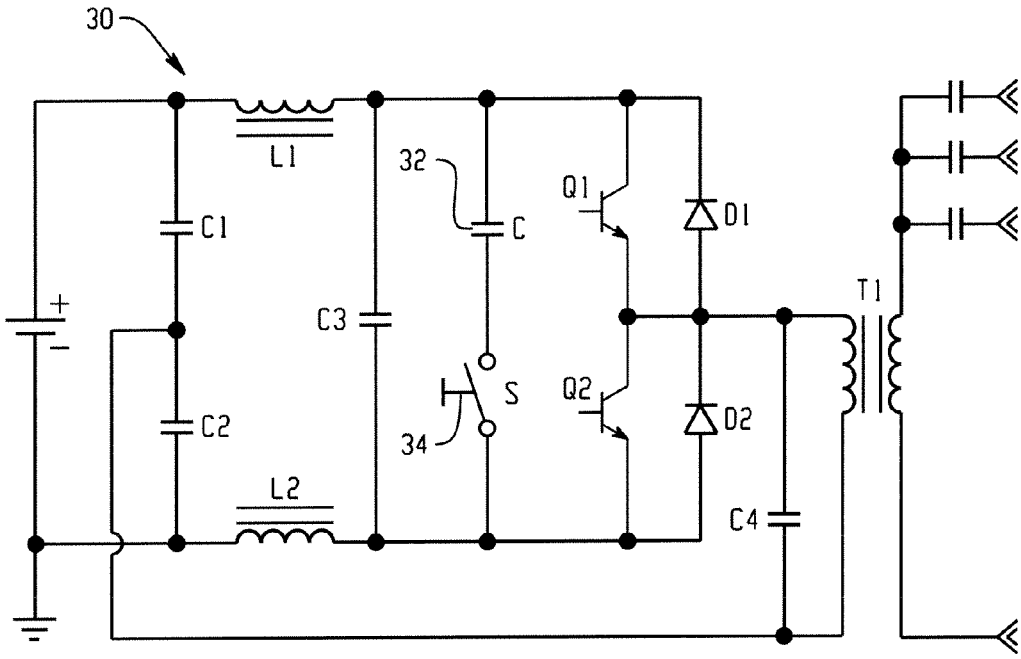
FIG. 2*a* is a schematic of a version of a power circuit for a gas discharge lamp having an auxiliary capacitance switchable in parallel with the inverter.

Referring to FIG. 2*a*, another version of a power or ballast circuitry for a gas discharge lamp is indicated generally at 30 wherein the like components for the circuit of FIG. 1 are denoted with like reference characters. The circuitry 30 of FIG. 2*a* has the auxiliary capacitance 32 and series user operated switch 34 connected in parallel across the inverter transistors Q1, Q2 instead of employing the auxiliary capacitance in the transformer secondary as was the case in the circuit of FIG. 1*a*. Upon closure of the switch 34, the capacitance 32 is operative to reduce the resonant frequency of the coupled inductors L1, L2 and the switches Q1, Q2, thereby reducing the power frequency to the primary transformer T1 and thus reducing power to the lamps. Upon opening of the switch 34 by the user, the normal or higher frequency voltage is applied to the primary transformer T1 and thus full power is delivered to the lamps through the transformer.

Figure 2B:
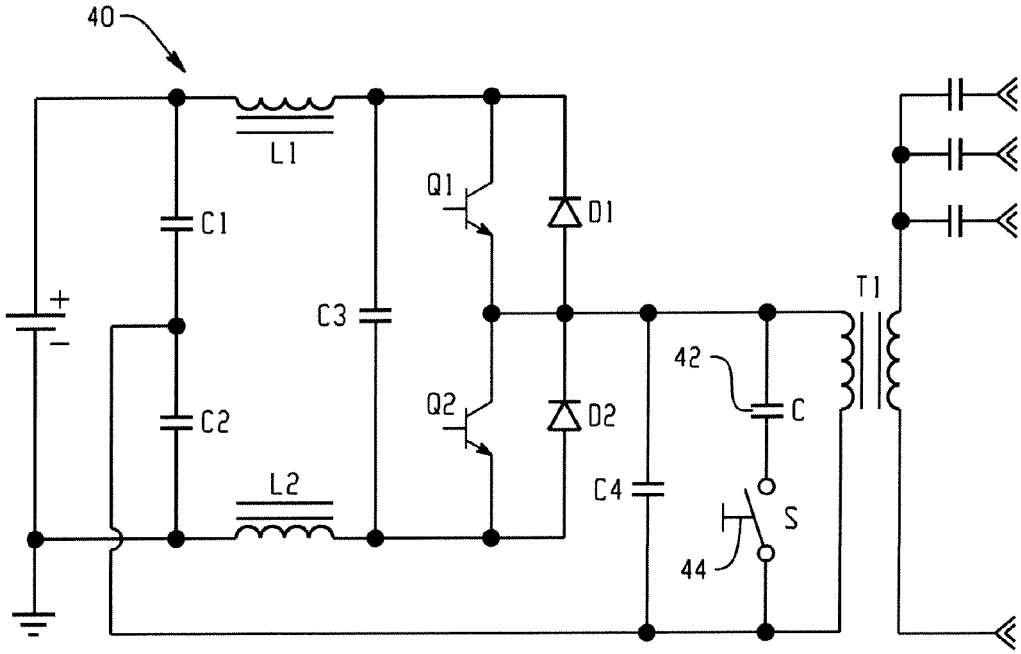
FIG. 2*b* is a schematic of another version of a power circuit for a gas discharge lamp with an auxiliary capacitance switchable in parallel with the output transformer primary winding.

Referring to FIG. 2*b*, another version of the ballast circuitry is indicated generally at 40 wherein like components are denoted with like reference characters to those of the circuit of FIG. 1. However, in the version 40, the auxiliary capacitance 42 is connected in parallel with capacitance C4 and the primary of the transformer T1 with a series switch 44 connected to enable the user to switch the capacitance 42 in and out of circuit. Upon opening of the switch 44, the normal or higher frequency power is delivered by the inverter switches Q1, Q2 to the primary transformer and thus full illumination of the lamps results. Upon closure of the switch 44, the frequency of the voltage applied form the inverter switches Q1, Q2 to the primary transformer T1 is reduced; and, thus a lower level of power is delivered to the lamps through the transformer.

Figure 2C:
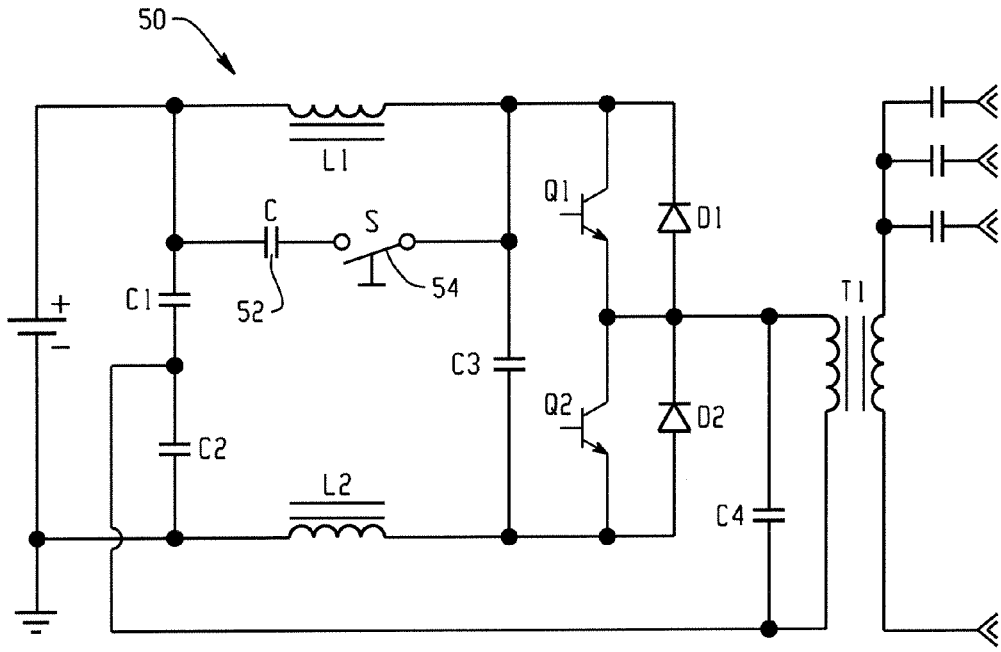
FIG. 2*c* is a schematic of another version of a power circuit for a gas discharge lamp with an auxiliary capacitance switchable in parallel with a power line inductor and capacitances.

Referring to FIG. 2C, another version of the power or ballast circuitry of the present disclosure is indicated generally at 50 which has an arrangement similar to that of the circuitry of FIG. 1 and where like components have like reference characters. However, in the embodiment of the version 50 of FIG. 2*c*, the auxiliary capacitance is connected in parallel with the inductors L1 and the capacitances C1, C2 and C3 wherein the auxiliary capacitance is denoted by reference numeral 52. A user operated switch 54 is connected in series with the capacitance 52; and, upon the user closing switch 54, auxiliary capacitance 52 is added in circuit and effectively reduces the resonant frequency of the coupled inductors and thus the frequency of the voltage delivered by inverter switches Q1, Q2 to the primary transformer T1 resulting in lower power and reduced illumination of the lamps. Upon the user opening switch 54, a normal or higher frequency voltage is applied form the inverter switches Q1, Q2 to the primary transformer T1 and thus full illumination of the lamps is effected.

Figure 2D:
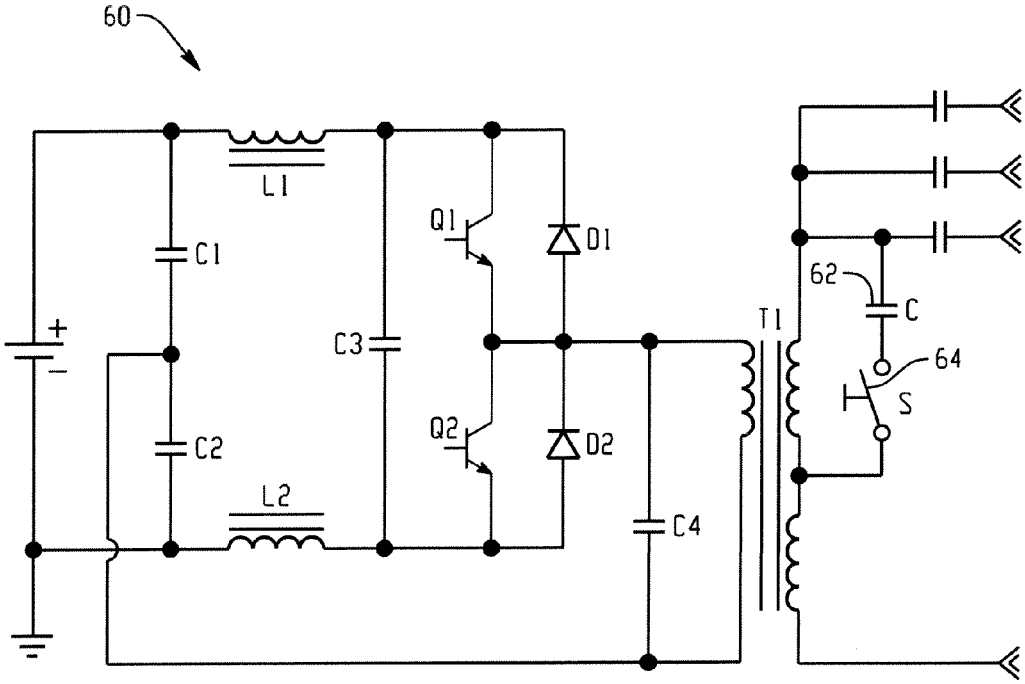
FIG. 2*d* is a schematic of another version of a power circuit for a gas discharge lamp with an auxiliary capacitance switchable in parallel with one half of the secondary winding of the output transformer.

Referring to FIG. 2*d*, another version of the power or ballast circuitry of the present disclosure is indicated generally at 60 and is similar in general arrangement to the circuit of FIG. 1, where like components have like character designations with the circuit of FIG. 1. The version 60 of FIG. 2*d* has the auxiliary capacitance 62 now connected in parallel to the secondary winding of transformer T1 with a series switch 64 connected as a center tap to the secondary of the transformer T1. The closure of switch 64 by the user connects the capacitance 62 in circuit with a portion of the transformer secondary winding and thus results in a lower frequency for the output voltage and reduced illumination to the lamps. Opening of switch 64 by the user disconnects capacitance 62 from the transformer and provides normal or higher frequency power to the lamps connected to the effected portion of the transformer secondary winding. The lamps connected to the remaining portion of the transformer secondary winding remain unaffected by the switch 64. The version 60 of FIG. 2*d* thus permits multiple lamps to be connected to the transformer secondary wherein some of the lamps are provided with a user operated switch for reducing power thereto; whereas, a remaining lamp may be connected for only full power operation.

Figure 2E:
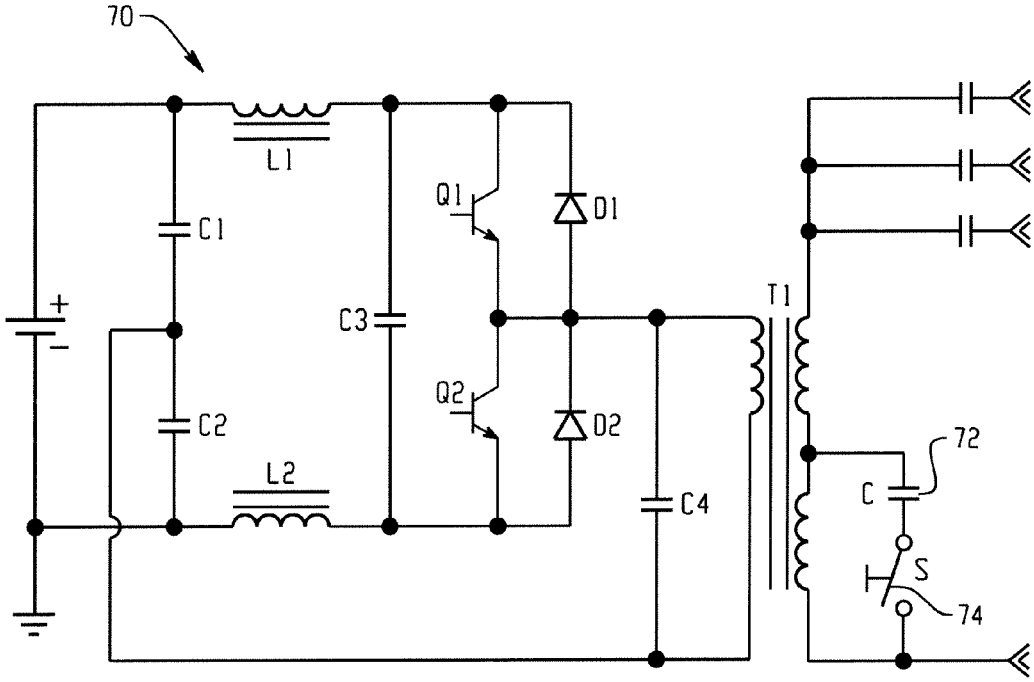
FIG. 2*e* is a schematic of another version of a power circuit for a gas discharge lamp with an auxiliary capacitance switchable in parallel with one half of the secondary winding of the output transformer.

Referring to FIG. 2*e*, another version of the power or ballast circuit of the present disclosure is indicated generally at 70 and has a general arrangement similar to that of FIG. 1 where like components have like reference characters. In the version 70, an auxiliary capacitance is connected in parallel with a single lamp load converted to one side of the secondary winding of transformer T1; and, a series witch 74 is connected to a center top of the transformer secondary winding. Closure of switch 74 results in a lower frequency power output to the single lamp, whereas power to the other portion of the transformer secondary winding and its plural lamp loads is not affected.

Figure 2F:
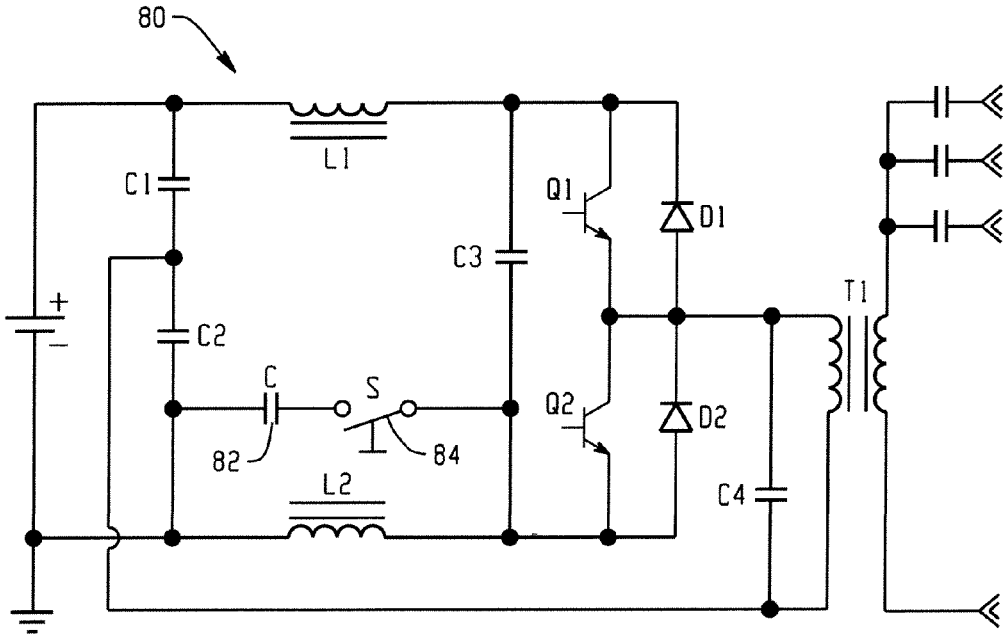
FIG. 2*f* is a schematic of another version of a power transformer circuit with an auxiliary capacitance switchable in parallel with a power line inductor and capacitances.

Referring to FIG. 2*f*, another version of the power or ballast circuitry of the present disclosure is indicated generally at 80 and has a general arrangement similar to that of the version described with respect to FIG. 1 where like components have like reference characters. However, in the version 80, an auxiliary capacitance is connected across inductor L2 and parallel therewith as denoted by reference numeral 82 and includes a series switch to be operated by the user as denoted by reference numeral 84. The closure of switch 84 by the user alters the resonant frequency of the inductor L2 and thus reduces the frequency of the inverter switches Q1, Q2 and the resultant power to the primary transformer T1 resulting in lower power to the lamps and lower illumination thereof. Upon the user opening switch 84, the inductor L2 induces its normal frequency of operation in the circuit and thus the frequency applied to switches Q1, Q2 resulting in full power to the primary of the transformer T1 and to the lamps.

Figure 3A:
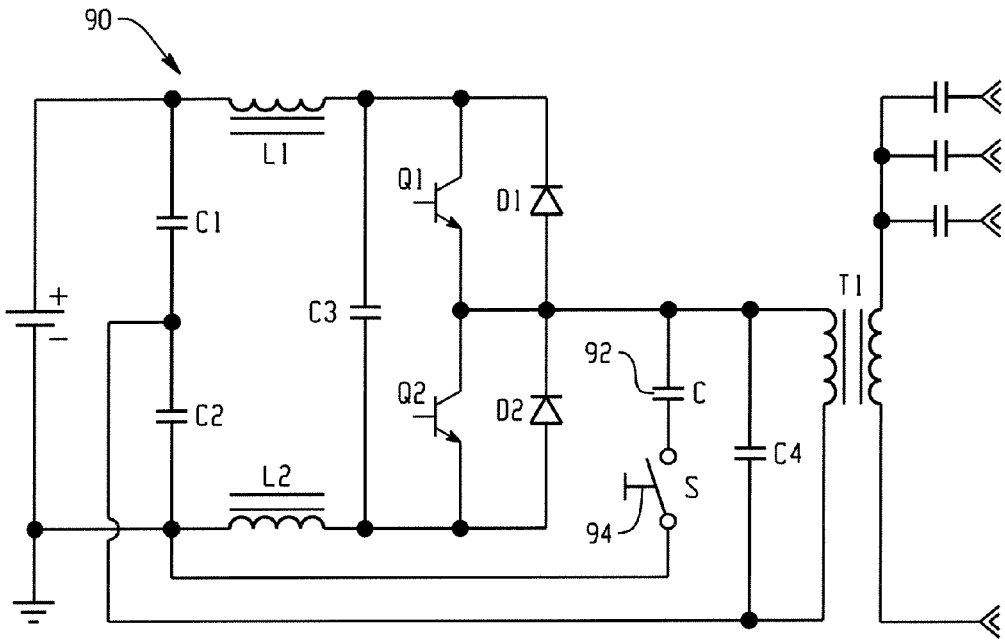
FIG. 3*a* is a schematic of another version of a power circuit for a gas discharge lamp with an auxiliary capacitance switchable in parallel with one inverter switch and power line inductor.

Referring to FIG. 3*a*, another version of the power or ballast circuitry of the present disclosure is indicated generally at 90 with the basic arrangement similar to that of the version of FIG. 1*a* wherein like circuit elements have like reference characters. In the version 90 of FIG. 3*a*, an auxiliary capacitance 92 is connected across one side of the inverter switch Q2 and inductor L2 with a series connected switch 94. Upon closing of switch 94, the frequency of the voltage output of the inverter is reduced and consequently, the power to the primary transformer T1 resulting in lower illumination of the lamps. Upon opening of switch 94, normal operation of the inverter is achieved and the higher frequency voltages apply to the primary transformer T1 resulting in full power and illumination of the lamps.

Figure 3B:
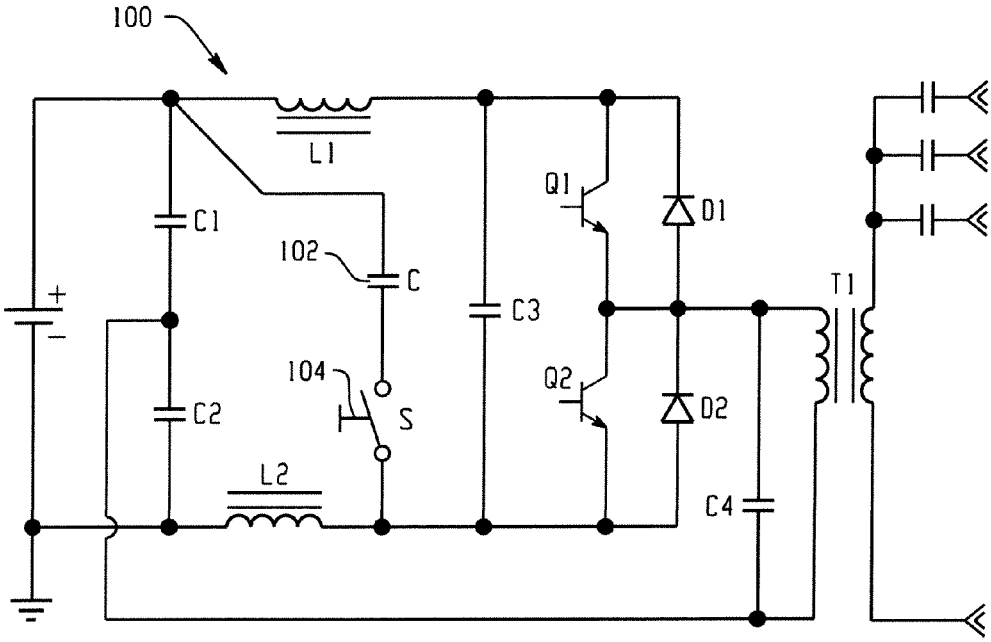
FIG. 3*b* is a schematic of another version of a power circuit for a gas discharge lamp with an auxiliary capacitance switchable in parallel with a power line inductor.

Referring to FIG. 3*b*, another version of the power or ballast circuitry of the present disclosure is indicated generally at 100 and has a basic arrangement similar to that of FIG. 1, wherein like circuit components have like reference characters. In the version 100 of FIG. 3*b*, an auxiliary capacitance 102 and a series switch 104 are connected in parallel with inductor L2 and capacitor C1, C2 to alter the frequency of the resonance of the inductor circuit. Upon opening of the switch 104 full normal resonance of the inductor circuit is achieved and the higher frequency power is applied through the inverter switches Q1, Q2 and thus to the primary transformer resulting in normal illumination of the lamps. Upon closure of the switch 104, the resonance of the inductor circuit is reduced and lower frequency voltage is applied to the primary of the transformer T1 by inverter switches Q1, Q2 resulting in lower output of the transformer and lower illumination of the lamps.

Figure 3C:
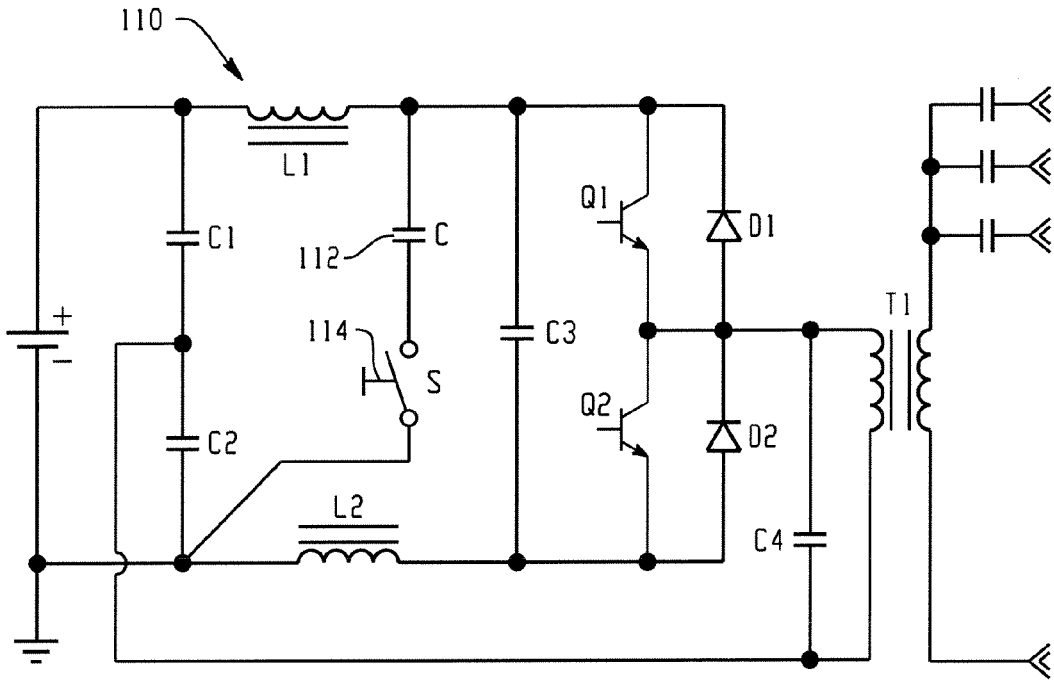
FIG. 3*c* is a schematic of another version of a power circuit for a gas discharge lamp with an auxiliary capacitance switchable in parallel with a power line inductor.

Referring to FIG. 3*c*, another version of the power or ballast circuitry of the present disclosure is indicated generally at 110. In the circuit of FIG. 3*c*, the basic arrangement is similar to that of FIG. 1 with like circuit elements having like reference characters. Circuit 110 includes an auxiliary capacitance 112 with series switch 114 which components 112, 114 are connected in parallel with inductor L1 and capacitor C1, C2. In version 110 of FIG. 3*c*, opening of switch 114 results in normal or higher frequency output of inverter switches Q1, Q2 to the primary transformer T1 resulting in normal or full illumination of the lamps. Upon closure of the lamps 114, the added capacitance 102 results in a lower frequency output of inverter switches Q1, Q2 to the transformer primary winding and thus reduced power output thereof and lower illumination of the lamps.

Figure 3D:
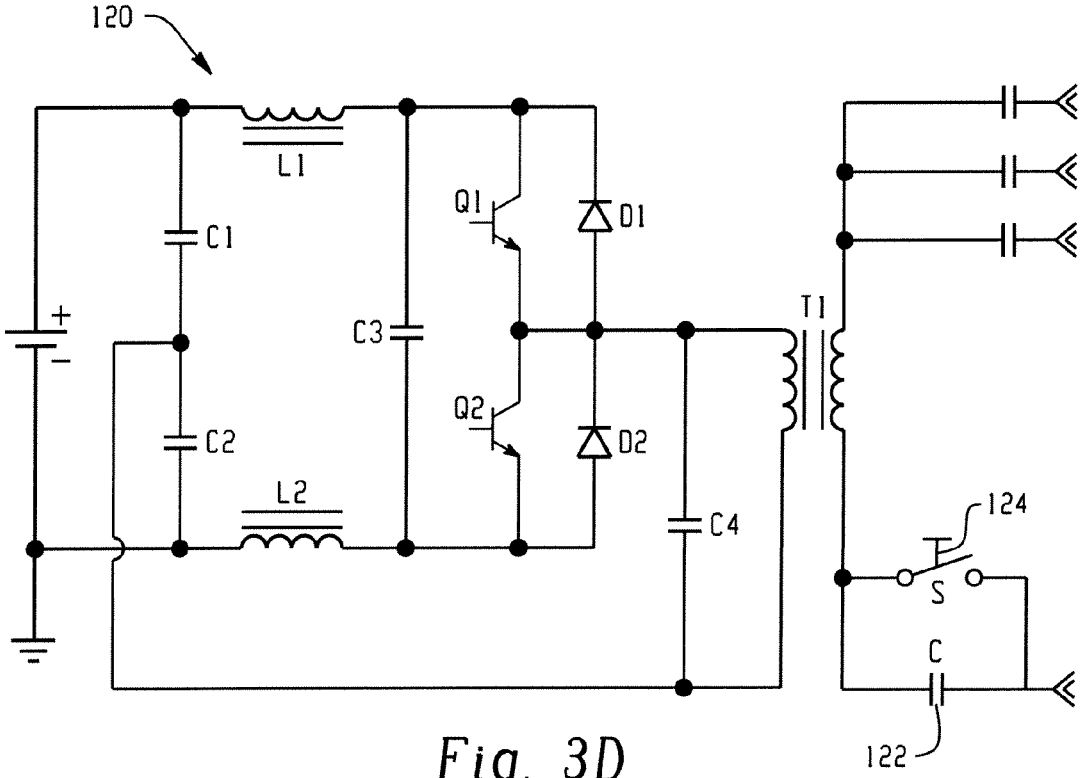
FIG. 3*d* is a schematic of another version of a power circuit for a gas discharge lamp with an auxiliary capacitance switchable in series with the secondary winding of the output transformer.

Referring to FIG. 3*d*, another version of the power or ballast circuitry of the present disclosure is indicated generally at 120 and has a basic circuit arrangement similar to that of FIG. 1, wherein like circuit components bear like reference characters. In the version 120, an auxiliary capacitance denoted by reference numeral 122 is connected in series with the transformer secondary which is connected to one of the lamps (not shown) and a switch 124 is connected in parallel with the capacitance 122. Upon closure of the switch 124, the capacitance 122 is shunted and normal or higher frequency power is applied from the secondary of transformer T1 to the lamp connected to capacitance 122. Upon opening of the switch, the shunt is released and the capacitor 122 placed in the circuit which results in lower frequency power being delivered to the particular lamp and reduced illumination thereof.

Figure 3E:
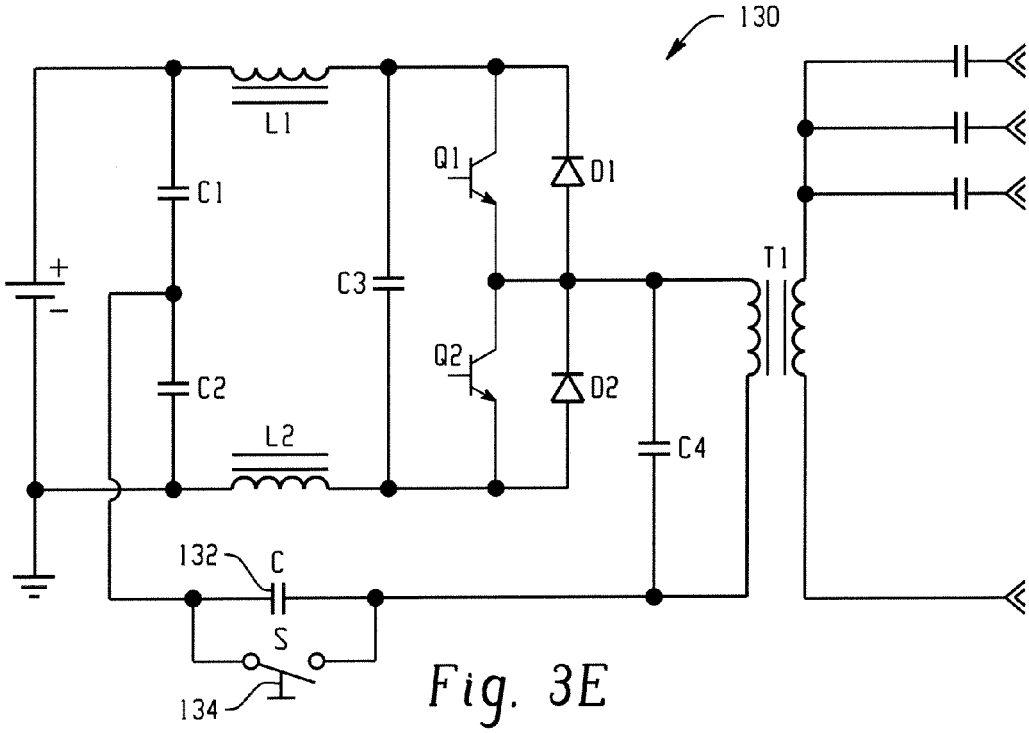
FIG. 3*e* is a schematic of another version of a power circuit for a gas discharge lamp with an auxiliary capacitance switchable in series with the primary winding of the output transformer.

Referring to FIG. 3*e*, another version of the ballast circuitry of the present disclosure is indicated generally at 130 and has a basic circuit configuration similar to that of FIG. 1 where like circuit components bear like reference characters. In the version 130 of FIG. 3*e*, an auxiliary capacitance 132 is series connected with the primary winding of transformer T1; and, capacitor 132 has a user operated switch 134 connected in parallel therewith. Upon the user closing of switch 134, the switch shunts or by-passes the capacitor 132 resulting in higher frequency voltage being applied to the transformer primary and resultant normal or full power illumination of the lamps. Upon opening of the switch 134, the capacitor 132 is placed in circuit and reduces the frequency of the frequency of power to the primary of the transformer T1 and lowers the illumination of the lamps connected to the transformer secondary.

Figure 3F:
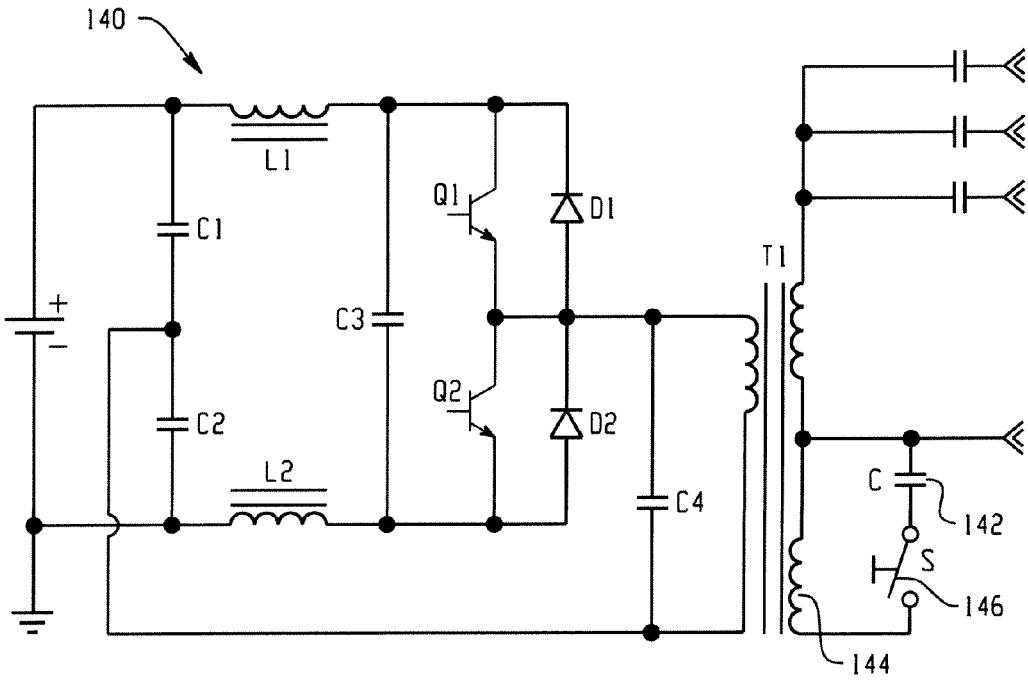
FIG. 3*f* is a schematic of another version of a power circuit for a gas discharge lamp with an auxiliary capacitance switchable in parallel with one half of the secondary winding of the output transformer.

Referring to FIG. 3*f*, another version of the power or ballast circuitry of the present disclosure is indicated generally at 140 which has a basic circuit configuration similar to that of FIG. 1 where like components bear like reference character designation. In the version 140 of FIG. 3*f*, an auxiliary capacitor (as denoted by reference character 142) is connected in parallel with an auxiliary winding 144 added to the secondary of the transformer for connection to one of multiple lamps (not shown) connected to the transformer secondary. A user operated switch 146 is connected in series with the capacitor 142 such that upon closure of the switch 146, the voltage output of the auxiliary winding 144 to the lamp associated therewith is reduced in frequency and lower illumination of the lamp results. Upon opening of switch 146 normal power or higher frequency voltage from the transformer secondary is applied to the associated lamp.

Figure 4:
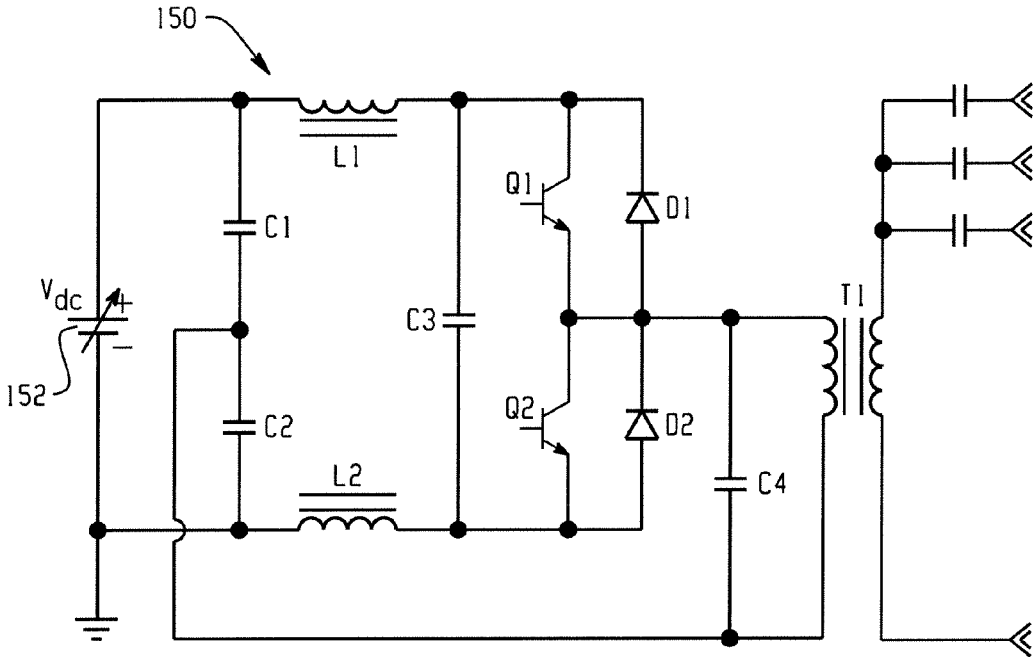
FIG. 4 is a schematic of another version of a power circuit for a gas discharge lamp with a variable DC supply voltage.

Referring to FIG. 4, another version of the power or ballast circuitry of the present disclosure is indicated generally at 150 and in its general arrangement is similar to that of the circuit of FIG. 1 where like components bear like reference character designation. In the version 150 of FIG. 4, the supply voltage DC is variable as denoted by reference numeral 152 and thus enables user adjustment of the voltage implied to the coupled inductors L1, L2 and the inverter switches Q1, Q2 and thus the primary transformer T1 resulting in varied power output to the lamps. However, it will be understood that the addition of a variable voltage control to the circuit includes the resultant increased cost associated therewith.

Figure 5:
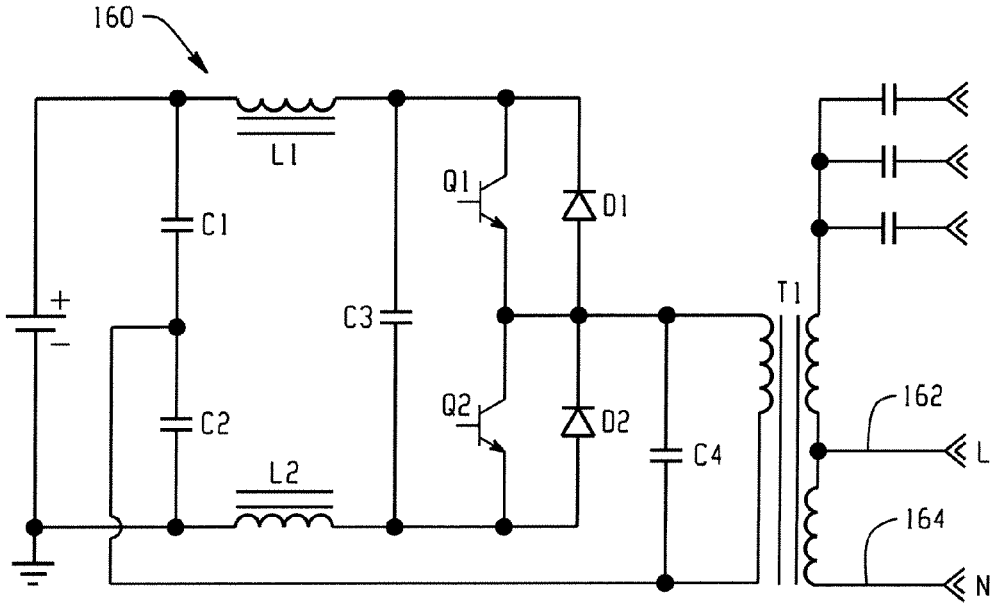
FIG. 5 is a schematic of another version of a power circuit for a gas discharge lamp with the secondary winding of the output transformer center tapped to provide a reduced power connection terminal.

Referring to FIG. 5, another version of the power or ballast circuitry of the present disclosure is indicated generally at 160 and has a basic circuit arrangement similar to that of FIG. 1 where like components share like reference characters. In the version 160, the secondary output winding of the transformer T1 is center tapped for a lower frequency, lower level power output connection denoted by reference numeral 162 enabling the user to hardwire the lamp thereto. In addition, a normal or higher level power output terminal is provided as denoted by reference numeral 164 for enabling the user to hardwire a lamp to the higher power output.

Figure 6:
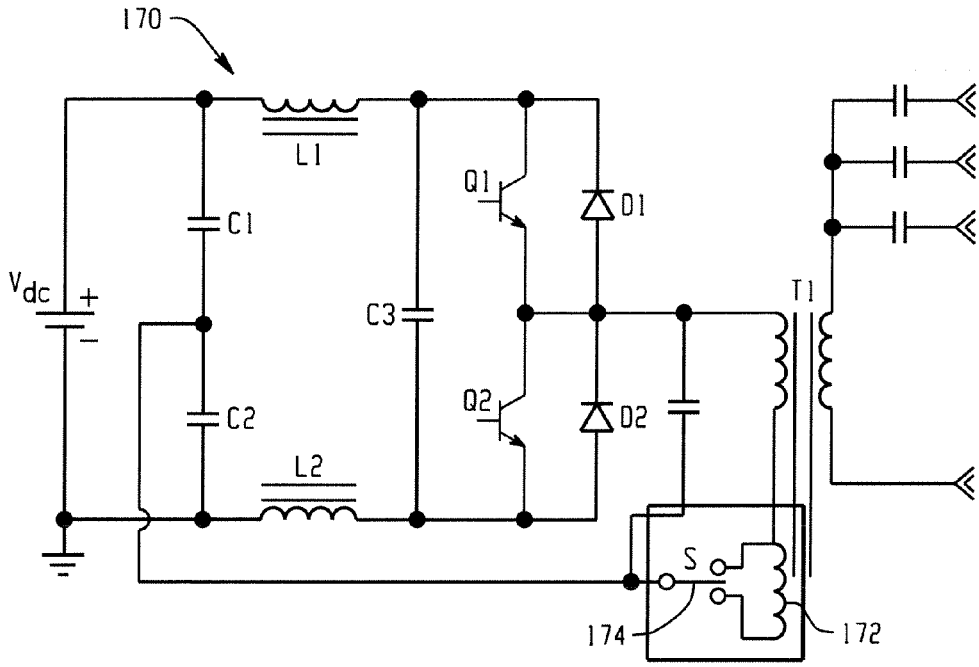
FIG. 6 is a schematic of another version of a power circuit for a gas discharge lamp with a series switchable auxiliary primary winding for the output transformer; and, FIG. 7 is a schematic of a prior art power circuit for a gas discharge lamp.
Figure 7:
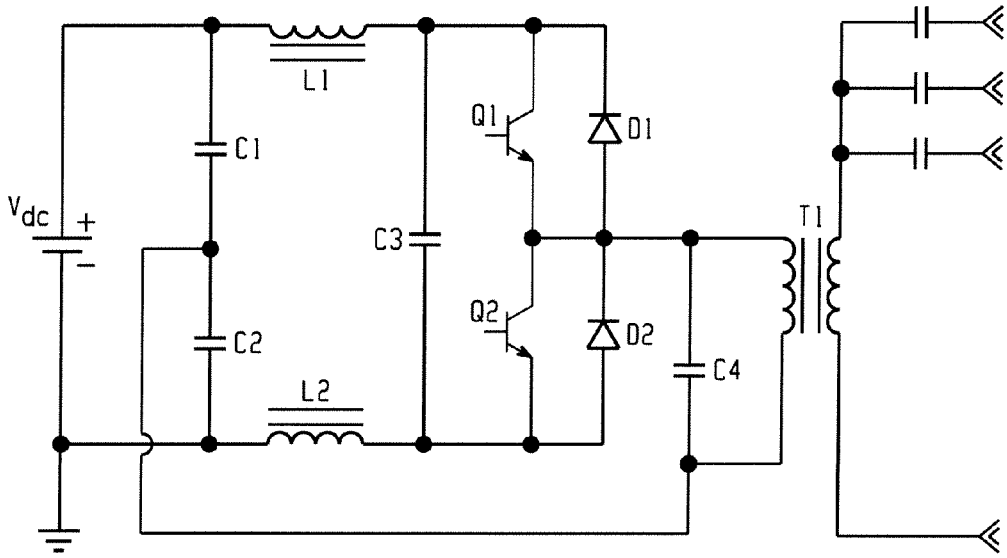
Fig. 7 PRIOR ART

Referring to FIG. 6, another version of the converter circuitry of the present disclosure is indicated generally at 170 and has a basic circuit configuration similar to that of FIG. 1 where like circuit components bear like reference character designations. However, the version 170 of FIG. 6 has an auxiliary winding connected to the primary of the transformer T1. A user operated switch 174 is connected in parallel across the auxiliary winding 172. Switch 174 is a single pole/double throw switch in which the switch, in the upper position, shunts the winding 172 resulting in normal or higher frequency power to the existing winding of the transformer T1 and full power illumination of the lamps. Upon the user moving switch 174 downwardly to the lower terminal thereof, the auxiliary winding 172 is connected in circuit resulting in greater inductance of the primary windings of the transformer T1 and lower frequency in the primary winding circuit resulting in lower power output to the secondary and lower illumination of the lamps.

The present disclosure thus provides a technique for providing multi-level operation of ballast circuitry for discharge lamps. In one version, an auxiliary capacitance is switched in and out of circuit by a user controlled switch for lower the frequency of the voltage from the inverter to the transformer resulting in lower power output to the lamps. In another version, the auxiliary capacitance may be switched in and out of circuit by a user operated switch wherein the capacitance is connected to the secondary or output winding of the transformer for selectively reducing power to the lamps for reduced illumination. In other versions, auxiliary inductances are selectively switched in and out of circuit to alter the frequency of the primary voltage to the transformer. In another version, an auxiliary winding is selectively switched in and out of the secondary of the transformer for providing normal and reduced level power to the lamps. In another version, a variable direct current power supply is provided to the coupled inductors of the ballast circuitry for user control of the power supply to the ballast circuitry.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A method of changing a power input to a gas discharge lamp comprising:

(a) providing a ballast connected to a source of direct current having a current inverter connected to a primary winding of a transformer and connecting a secondary winding of a transformer to the lamp;

(b) selectively coupling a capacitance in the secondary winding by center tapping and lowering a resonant frequency and a power output to the lamp; and, (c) selectively uncoupling the capacitance and raising the resonant frequency and the power output to the lamp.

2. The method defined in claim 1, wherein the step of selectively coupling a capacitance includes switching and unswitching a capacitance electrically in parallel with the secondary winding.

3. A method of changing a power input to a gas discharge lamp comprising:

(a) providing a ballast connected to a source of direct current having a current inverter connected to a primary winding of a transformer and connecting a secondary winding of the transformer to the lamp;

(b) selectively coupling an additional inductance in series with the primary winding and lowering the resonant frequency of the primary winding and reducing the power input to the lamp; and, (c) selectively uncoupling the additional inductance and increasing the resonant frequency of the primary winding circuit and increasing the power to the lamp.

4. The method defined in claim 3, wherein the step of selectively coupling and uncoupling include connecting a double-throw switch in circuit.

5. The method defined in claim 3, wherein the step of selectively coupling includes connecting the capacitance electrically in parallel with the primary winding.

6. A method of changing the power input to a gas discharge lamp comprising:

(a) providing a ballast connected to a source of direct current with a current inverter connected to a primary winding of a transformer and connecting a secondary winding of the transformer to the lamp;

(b) center tapping the secondary winding of the transformer and providing a low power connection for the lamp; and, (c) providing an additional connection across the transformer secondary winding for a higher power connection for the lamp.

7. A method of changing a power input to a gas discharge lamp comprising:

(a) providing a ballast connected to a source of direct current having a current inverter connected to a primary winding of a transformer and connecting a secondary winding of the transformer to the lamp;

(b) controlling a supply voltage DC of the inverter to be variable; and (c) selectively changing the inverter supply voltage DC to change a resonant frequency of the inverter thereby changing the lamp current according to user's requirement.

* * * * *